United States Patent [19]

Colonel et al.

[11] Patent Number: 4,798,009

[45] Date of Patent: Jan. 17, 1989

[54] SPRING APPARATUS FOR SHOE SOLES AND THE LIKE

[76] Inventors: Richard C. Colonel, Box 2192, Renton, Wash. 98056; Devere Lindh, 1910 Dogwood Dr. SE, Auburn, Wash. 98002

[21] Appl. No.: 174,035

[22] Filed: Mar. 28, 1988

Related U.S. Application Data

[63] Continuation-in-part of Ser. No. 48,308, May 11, 1987, abandoned.

[51] Int. Cl.[4] ..... A43B 13/18

[52] U.S. Cl. ..... 36/28; 36/29; 36/30 R

[58] Field of Search ..... 36/28, 30 R, 30 A, 31, 36/32

[56] References Cited

U.S. PATENT DOCUMENTS

| | | | |
|---|---|---|---|
| 3,834,046 | 9/1974 | Fowler | 36/28 |
| 4,267,648 | 5/1981 | Weisz | 36/28 |
| 4,283,864 | 8/1981 | Lipfert | 36/28 |
| 4,451,994 | 6/1984 | Fowler | 36/28 |
| 4,494,322 | 1/1985 | Klagmann | 36/28 |
| 4,521,979 | 6/1985 | Blaser | 36/29 |
| 4,535,553 | 8/1985 | Derderian et al. | 36/28 |
| 4,608,768 | 9/1986 | Cavanagh | 36/28 |
| 4,616,431 | 10/1986 | Dassler | 36/28 |
| 4,656,760 | 4/1987 | Tonkel et al. | 36/28 |

*Primary Examiner*—Donald Watkins
*Attorney, Agent, or Firm*—Robert W. Jenny

[57] ABSTRACT

The spring comprises layers of resilient material connected and spaced apart by compression members. The compression members are also spaced apart and indexed so that those between one pair of layers are located opposite the spaces between the compression members between the adjacent pair of layers. Springs of various shapes and areas are cut from sheets of spring structure and the spring rates are expressed in terms of pounds per inch per square inch of spring work area. Spring rates range from 1000 to 1250 pounds per inch per square inch of spring. Work capacities range from 13 to 120 inch pounds per square inch of spring. Ratios of work capacity to weight range from about 200 for springs about ¼ inch thick to 600 for springs ¾ inch thick. The cavities in the springs are vented to ambient to enhance linearity and efficiency.

17 Claims, 2 Drawing Sheets

FIG. 4
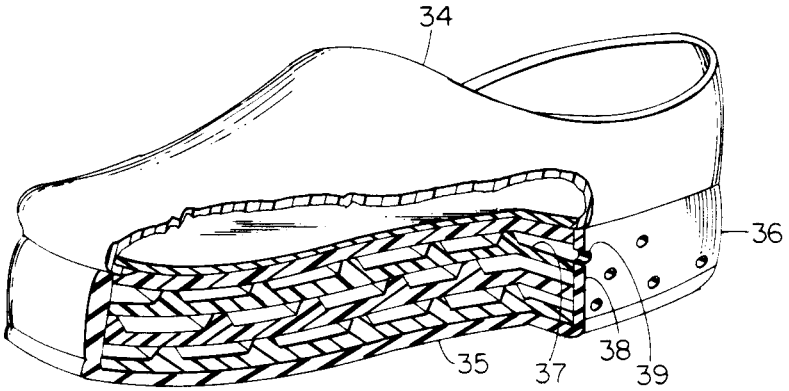
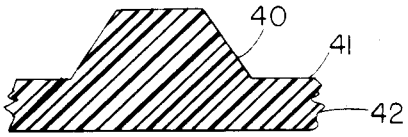
FIG. 5

SPRING APPARATUS FOR SHOE SOLES AND THE LIKE

The subject application is a continuation-in-part Application of U.S. application Ser. No. 048,308, filed 5/11/87, to be abandoned when the subject application is duly filed.

BACKGROUND OF THE INVENTION

1. FIELD:

The subject invention is in the field of springs, particularly springs involving relatively small deflections and high spring rates. Still more particularly it is in the field of springs used in the soles of footwear.

2. PRIOR ART:

There is profues prior art in this field exemplified by the following patents, selected from 49 patents found in a preliminary search of prior art related to the subject invention.

| | | | | |
|---|---|---|---|---|
| U.S. Pat. No.: | 291,490 | 2,468,886 | 3,822,490 | 4,283,864 |
| | 354,986 | 2,565,108 | 3,384,040 | 4,451,994 |
| | 1,693,911 | 2,668,374 | 4,187,620 | 4,521,979 |
| | 2,434,770 | 2,953,861 | 4,267,648 | 4,535,553 |
| | | | | 4,536,974 |
| British: | 565,723 | | | |

The basic problem addressed by the listed inventions is a combination of (1) reduction of the chances of the occurrence of foot damage and associated pains and injuries resulting from walking, running, jumping and the like and (2) corollary potential for improvement of the performance of the wearer of shoes having resilient soles in terms of increased stamina and/or improved athletic capabilities. NOTE: For purposes of this disclosure the term sole is construed to mean all or part of the elements of footwear supporting a wearer's foot. The longstanding need for a solution to this combination of problems continues in spite of the efforts made to solve them as evidenced by the profusion of prior art. Specifically, the need is for springs, and shoe soles with the springs incorporated into them, which provide specific levels of spring capability (energy absorption and release) for lower weight and smaller size than has yet been provided. This can be accomplished in large part by providing springs having essentially linear spring rates. Further, this accomplishment can be supplemented by providing a range of springs having a range of associated spring rates to suit a range of weights of users. This accomplishment is achievable only if the spring characteristics can be accurately predicted and produced. Also, it has been determined that prior art shoe sole springs are not adequately stable laterally, i.e. they deflect in directions essentially parallel to the sole of the shoe into which they are incorporated. Accordingly, the prime objective of the subject invention is the provision of springs which can be incorporated into the soles of footwear and provide improved ratios of energy storage and release capabilities of the soles to both weight and size of the soles. More specifically, it is an objective to provide springs having essentially linear spring rates. It is an objective that the springs have high efficiency and further it is an objective that the spring features readily enable provision of a range of springs having a range of spring rates related to the weights of the users of footwear incorporating the springs. It is a further objective that the spring rates be accurately predictable and producible. Another objective is that the springs be laterally stable, i.e. their deflection capability be restricted essentially to the direction normal to the soles of shoes into which the springs are incorporated. A further objective is that the springs concept enable relatively simple and economical manufacture of the resilient soles. Further objectives will become evident to those skilled in the art from understanding of this disclosure.

SUMMARY OF THE INVENTION

The subject invention achieves its objectives primarily as a result of the combination of the concept of the spring structure and the characteristics of the materials from which the apparatus incorporating the concept is made.

The spring concept involves layers of resilient material spaced apart by compression members. The locations and spacing of the compression members are such that the members bearing on one side of each layer are aligned with the spaces between the members on the other side. The result is that compression loads applied to the outermost layers of compression members in the interleaved stack of layers and compressions members cause the layers to deflect in ripple or wave form, depending on the nature and disposition of the compression members. The spring rate of the spring system depends on the number of layers active in the stack, their thicknesses the distances between the compression members and the material characteristics. Pneumatic spring actions are specifically limited to providing damping and not depending on for shock relief since pneumatic functions are non-linear and tend to change with temperature and be difficult to predict. The maximum deflection can be limited by selection of the heights of the compression members, i.e. distances between the layers. Springs (i.e. spring systems) according the this concept can have a wide variety of configurations and capabilities, including spring rates variable over the area of the layers, again depending on the height and dispositions of the compression members, as well as variations in the thicknesses of the layers and/or gradations in the thicknesses of individual layers. The concept also readily lends itself to designs in which the resilient material is never stressed beyond desired limits, thus assuring durability of the resilient components.

The design flexibility of the subject concept, as described, makes it especially suitable for use in providing resilience in the soles of footwear. The loads and load distribution patterns produced depend on use conditions and various characteristics of the user. Further, soles of footwear are subjected to shear loads in the front-to-back, side-to-side and vice versa directions as well as the compression loads, so that there are requirements that the resilience providing component be able to withstand the shear loads and provide alteral stability, i.e. not deflect unduly in directions essentially parallel to the plane of the shoe sole into which the spring is incorporated. The subject concept satisfies these requirements because lateral deflection of one layer relative to adjacent layers is enabled by tilting or "rolling" of the compression members and related deformation of the layers. The degrees of lateral (or shear) deflection and resilience are influenced significantly by the areas, shapes and distributions of the crossections of the compression members. It has been found that cross compression members having a trapezoidal crossectional shape with the broad parallel sides next to surface layers provide a satisfactory compromise between the lateral stability and resilience.

A typical basic embodiment of the subject concept in the sole of a shoe comprises, for example, a first layer adjacent to the wear layer which forms the bottom of the sole, compression members upstanding on the first layer and supporting a second layer and compression members upstanding on the second layer and supporting a third layer just under the inner sole of the sole assembly. The compression members are spaced apart equidistantly and run from side to side of the sole assembly. The two sets of compression members are indexed so that one set is located midway between the other set in the front/back direction of the shoe.

The spring can be considered to comprise a shoe sole component known in the art as a midsole. To suit a variety of types of shoes made for various purposes and for users in a range of weights, the midsole thickness will range from ¼ to ¾ of an inch. The thickness of a midsole may vary over its length and/or width. The maximum deflection ranges from 0.1 of an inch to 0.4 of an inch and can be expressed as a percentage of the thickness for a given midsole (spring). The load capacities are in the range of 130 to 300 pounds per square inch of working surface. Total load depends on how much of the spring, i.e. how much of its working surface is loaded at any time.

In a preferred embodiment the layers are made from filament reinforced elastomeric material. Material hardness is a prime factor in the determination of the spring characteristics. In a preferred configuration each layer has compression members formed on one side and the spring is assembled by securing the compression member on one layer to the underside, i.e. smooth side of an adjacent layer by adhesive.

The springs are made in sheet form and midsoles are cut to peripheral shapes from the sheets.

It can be understood from the summary that the apparatus comprises a plurality of beams, fixed ended for stress and load calculation purposes and loaded at their centers. The assembly is stiff in side-to-side shear loading, moderately resilient in the front/back direction and fully resilient in the up/ down, compression load direction. The dimensions may be designed to provide a relatively high spring rate at the heel area with the rate decreasing from heel to toe. The layers may be perforated and/or notched and/or slotted as deemed advisable to achieve desired operational characteristics.

BRIEF DESCRIPTION OF THE DRAWINGS

FIG. 4 is a cutaway, sectioned perspective view of an article of footwear having a sole with the apparatus as shown in FIG. 3 incorporated into the sole.

FIG. 5 is an enlarged crossectional view of a compression member.

DETAILED DESCRIPTION OF THE INVENTION

Figure 1:
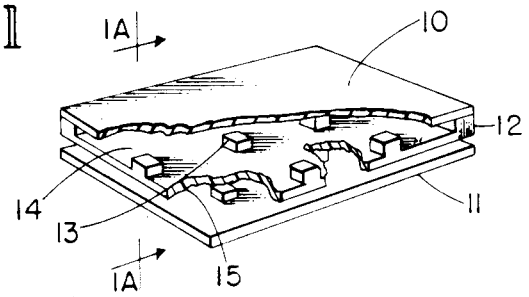
FIG. 1 is a sectional perspective view of one embodiment of the subject apparatus.
Figure 1A:
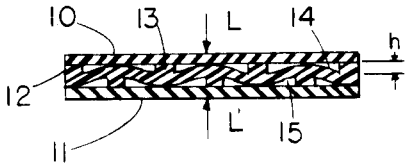
FIG. 1A is a sectional view of the embodiment of FIG. 1, taken at 1A-1A in FIG. 1 and under load.

The apparatus in FIG. 1 comprises layers 10 and 11, called outer layers and a third layer 12, termed an intermediate layer on which there is a plurality of struts, strut 13 being typical, some on side 14 of layer 12 and some on the other side 15. All three layers are resilient but the two outer layers are considerably stiffer than the intermediate layer. The struts, termed compression members, are spaced apart and the struts on side 14 are positioned opposite the space between the struts on side 15. The functional results of the relative positioning of the compression members are illustrated in FIG. 1A, a sectional view of the apparatus of FIG. 1 when assembled and under uniformly distributed compression load signified by the arrows L and L'. Under the compression load the intermediate layer is deflected by the compression members and, since the intermediate layer is resilient, the apparatus functions as a spring. The maximum deflection is determined by the height h of the compression members and the height is such that the stress in the intermediate layer is kept within acceptable limits in terms of the durability of the layer.

Figure 2:
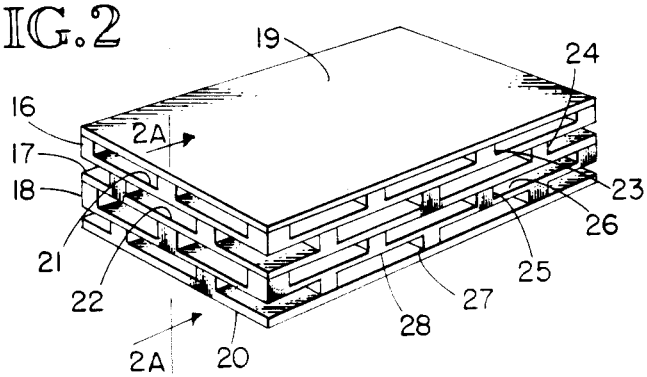
FIG. 2 is a sectional perspective view of a second embodiment.

The apparatus in FIG. 2 comprises multiple intermediate layers 16, 17 and 18 and outer layers 19 and 20. Layers 16 and 17 have compression members on one side each, sides 21 and 22, with members 23 and 24 being typical. Layer 18 has compression members 25 on side 26 and 27 on side 28.

Figure 2A:
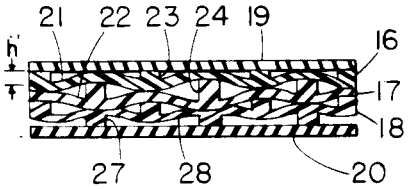
FIG. 2A is a sectional view of the embodiment of FIG. 2, taken at 2A—2A in FIG. 2 and under load.

FIG. 2A shows the apparatus of FIG. 2 insection and deflected to the maximum under compression load. In this instance the total deflection is the sum of the deflections of the three intermediate layers, each equal to ½ the height h' of the compression members, that is, $3 \times h2 = 1\frac{1}{2}$ h.

Figure 3:
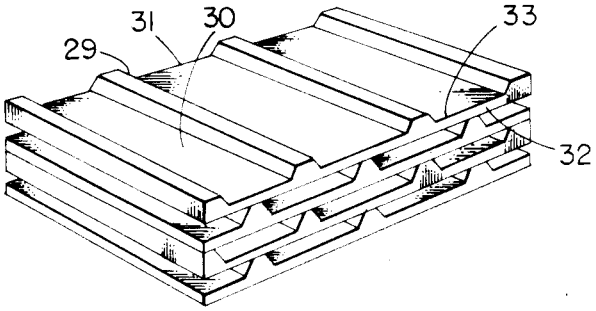
FIG. 3 illustrates a third, perferred embodiment in which the compression struts extend from edge to edge of the structure and are molded on one side of each layer in the assembly.

In FIG. 3 the compression members, member 29 being typical, extend from edge 30 to edge 31 of the apparatus. All the layers are identical, having a smooth side, side 30 being typical, and a side having compression members formed on it, side 33 being typical. The layers are made of fibre reinforced elastomeric material. A blank structure from which springs for use in shoe soles or the like may be cut is assembled by attaching the desired number of layers into a stack, using adhesives to attach the tops of the compression members on each layer to the smooth side of the adjacent layer with the compression members indexed so that those on alternate layers contact the adjacent layer essentially midway between the compression members on the other. The springs are cut so that the filament reinforcements are aligned transverse to the direction of the compression members.

FIG. 4 illustrates a shoe 34, with the subject spring 35 incorporated into the sole 36. The cavities, cavity 37 being typical, formed by the layers, compression members and enclosing material 38 are vented to ambient air, vent 39 being typical, to effectively eliminate the nonlinearizing effects of pneumatics on the spring action along with the energy losses associated with the alternate compression and expansion of the otherwise trapped air. The straightforward structural concept, not involving pneumatic functions, enhances the efficiency of the spring, its linearity and its predictability and producibility.

FIG. 5 illustrates a preferred crossectional shape 40 of a compression member. It is geneally trapezoidal and more specifically a truncated isosceles triangle with its base against the surface 41 of the layer 42 on which it is formed, such as by molding or extrusion. It has been found that this shape, with all other factors being equal, increases lateral stability of the spring structure.

In practice the springs are to be provided with ranges of characteristics to suit ranges of user parameters and ranges of use requirements. In all cases the weight of the spring is kept low relative to its energy storage and release capacity. The energy storage and release capacity, termed the work capacity, is measured in terms of load at maximum deflection and maximum deflection, both per square inch of spring working area. The spring working area is the planform area of a spring such as one used in a shoe sole. For example, a spring designed to have a maximum compression deflection of 0.3 of an inch and to reach that deflection under a load of 200 pounds applied over an area of 1 square inch of spring working surface has a work capacity of $0.3\times200=60$ inch pounds per square inch. The load range can be from 100 to 500 pounds per square inch of working area with a preferred range of 130 to 300 pounds per square inch of working area. The preferred range of maximum deflections is 0.1 to 0.4 of an inch. Therefore the preferred range of work capacity is $0.1\times130=13$ to $0.4\times300=120$ inch pounds per square inch of spring in an overall range of 10 to 200. The range of spring weight corresponding to this range of work capacity if 0.06 ounces to 0.2 ounces per square inch of spring. To embody these characteristics the spring thickness ranges from about ¼ to ¾ of an inch. The ratio of work capacity to weight range from about 210 for the thinner springs to about 600 for the thicker springs.

In springs with the noted load characteristics the spring rates are in the range of 1000 to 1250 pounds per inch per square inch of working area. The working capacity for springs comprising the minimum two layers is in the range of 10 to 100 inch pounds per square inch of working area. For springs of greater thickness and multiple layers, the working capcity is in the range of 20 to 250 inch pounds per square inch of working surface.

It is considered that this description will make clear to those skilled in the art that the invention meets its objectives. The springs can readily be incorporated into the soles of footwear and provide improved ratios of work capacity to weight and size. The combination of linear spring rates and avoidance of pneumatic operation enhances the spring efficiency. The design enables provision of springs having functional characteristics related to the weights of users. The simplicity of the structure enables accurate prediction of functional parameters and reliable production of springs having the parameters. The springs are stable laterally. They can be simply and economically manufactured.

It will be understood by those skilled in the art that while preferred embodiments of the subject invention are described herein, othe embodiments and modifications of those described are possible within the scope of the invention which is limited only by the attached claims.

What is claimed is:

1. A spring for use in shoe soles and the like, said spring comprising at least first and second layers of resilient material, each of said first and second layers having a first smooth face and a second face having compression members formed on it, said compression members having spaces between them and tops, said first and second layers being adhesively attached with said tops on said first layer attached to said first side of said second layer with said compression members on said first layer positioned opposite said spaces on said second layer.

2. The spring of claim 1 having a working area expressed in square inches and a spring rate in the range of 1000 to 1250 pounds per inch per square inch of said working area.

3. The spring of claim 1 having a working area expressed in square inches and a work capacity in the range of 10 to 100 inch pounds per square inch of said working area.

4. The spring of claim 2 having a work capacity in the range of 10 to 100 inch pounds per square inch of said working area.

5. A spring for use in shoe soles and the like, said spring comprising a plurality of layers, each of said layers having a first, smooth side and a second side having compression members thereon, said compression members having tops and square between them, said layers being assembled into a stack of altenate and adjacent layers with said tops adhesively attached to said first faces and said compression members on said alternate layers in said stack positioned opposite said spaces on said adjacent layers.

6. The spring of claim 5 having a working area expressed in square inches and a spring rate in the range of 1000 to 1250 pounds per inch per square inch of said working area.

7. The springs of claim 5 having a working area expressed in square inches and a work capacity in the range of 20 to 250 inch pounds per square inch of said working area.

8. The spring of claim 6 having a work capacity in the range of 20 to 250 pounds per inch per square inch of said working area.

9. The spring of claim 1, said compression members having a crossectional shape, said shape being a truncated isosceles triangle.

10. The spring of claim 2, said compression members having a crossectional shape, said shape being a truncated isosceles traingle.

11. The spring of claim 3, said compression members having a crossectional shape, said shape being a truncated isosceles triangle.

12. The spring of claim 4, said compression members having a crossectional shape, said shape being a truncated isosceles triangle.

13. The spring of claim 5, said compression members having a crossectional shape, said shape being a truncated isosceles triangle.

14. The spring of claim 6, said compression members having a crossectional shape, said shape being a truncated isosceles triangle.

15. The spring of claim 7, said compression members having a crossectional shape, said shape being a truncated isosceles triangle.

16. The spring of claim 8, said compression members having a crossectional shape, said shape being a truncated isosceles triangle.

17. The springs of claims 3, 4, 7, 8, 11, 12, 15 or 16 having a weight and an area expressed in square inches, the ratio of said work capacity per square inch of said area to said weight per square inch of said area being in the range of 210 to 600.

* * * * *